United States Patent [19]

Lore et al.

[11] 4,128,285

[45] Dec. 5, 1978

[54] THEFT-PROOF TABLE-TOP ENCLOSURE

[76] Inventors: Nicola Lore, 35 Burkhardt Ave., Bethpage, N.Y. 11714; Lino Di Meo, 6 Kings Ct., Plainview, N.Y. 11803

[21] Appl. No.: 825,086

[22] Filed: Aug. 16, 1977

[51] Int. Cl.[2] ..... A47B 19/10; A47B 37/00

[52] U.S. Cl. ..... 312/196; 312/284

[58] Field of Search ..... 312/196, 210, 213, 258, 312/295, 297, 140.2, 219, 284, 278, 279

[56] References Cited

U.S. PATENT DOCUMENTS

| | | | |
|---|---|---|---|
| 287,475 | 10/1883 | Ross | 312/196 |
| 494,406 | 3/1893 | Billington | 312/297 |
| 1,548,915 | 8/1925 | Smallbone | 312/219 |
| 2,552,380 | 5/1951 | Pickell | 312/258 |
| 2,943,901 | 7/1960 | Eaton et al. | 312/284 |
| 3,120,076 | 2/1964 | Zuch | 312/210 |
| 3,351,405 | 11/1967 | Ferdinand et al. | 312/196 |

FOREIGN PATENT DOCUMENTS

| | | | |
|---|---|---|---|
| 582841 | 12/1924 | France | 312/284 |

*Primary Examiner*—Mervin Stein
*Assistant Examiner*—Alex Grosz
*Attorney, Agent, or Firm*—Herbert L. Lerner

[57] ABSTRACT

A theft-proof collapsible enclosure for a table-top working area includes a plurality of panels disposed in closed condition of the enclosure, in separate mutually intersecting planes above the table-top working area, the plurality of panels forming a top wall, a front wall and two side walls of the enclosure in the closed condition thereof, the panels of at least the top wall and the front wall being pivotable about respective substantially horizontal axes at the mutual intersections thereof so as to collapse the enclosure.

8 Claims, 3 Drawing Figures

THEFT-PROOF TABLE-TOP ENCLOSURE

The invention relates to a theft-proof table-top enclosure, and particularly to an enclosure which covers a working area and which collapses so that the front, top and sides of the enclosure do not inhibit full use of the working area.

Theft is an ever-increasing problem in offices and factories where valuables may be left on the surface of the desk or work bench or in the drawers thereof. Enclosures in use today may lock in the closed position and drawers are often equipped with locks. However, the problem with these conventional enclosures is that parts of the enclosures remain in place and prevent full usage of the working area above the table-top. The enclosures which do have collapsible sides and tops are either too cumbersome to be practical or require too great an effort to collapse them. A further shortcoming is that a great deal of room is required to remove the sides of the enclosures. Such a large space is not available where tables or desks are placed close together.

It is therefore an object of the invention of the instant application to overcome the above-mentioned problems and shortcomings of the heretofore known devices of the general type and to provide a theft-proof enclosure for a table-top working area which is collapsible to an extent that it allows full usage of the working area.

With the foregoing and other objects in view, there is provided, in accordance with the invention, a theft-proof collapsible enclosure for a table-top working area including a plurality of panels disposed in closed condition of the enclosure, in separate mutually intersecting planes above the table-top working area, the plurality of panels forming a top wall, a front wall and two side walls of the enclosures in the closed condition thereof, the panels of at least the top wall and the front wall being pivotable about respective substantially horizontal axes at the mutual intersections thereof so as to collapse the enclosure.

In accordance with another feature of the invention, it is provided that the panels forming the side walls are pivotable about respective substantially horizontal axes at the mutual intersections thereof with the separate planes of the plurality of panels.

When the side panels are hinged to the top, they may be stored completely out of the way. Therefore, in accordance with a further feature of the invention, it is provided that the plurality of panels are disposed in one substantially vertical plane in a collapsed condition of the enclosure.

Another embodiment of the invention provides for sliding the side panels below the working area; therefore in accordance with an additional feature of the invention, it is provided that the panels forming the side walls are movable in the planes wherein they are disposed in the closed condition of the enclosure to a position below the working area.

In accordance with yet another feature of the invention, there are provided means for limiting downward movement of the panels forming the side walls to the position thereof below the working area.

In accordance with still a further feature of the invention, there are provided means for releasably securing the panels forming the side walls in the closed condition of the enclosure.

The novel enclosure of the invention may also serve a collateral purpose in eliminating the need for locks on drawers. In accordance with yet an additional feature of the invention, it is provided that the working area is at the top of a table having a drawer mounted below the working area, the drawer having a front surface with a substantially horizontal edge, and wherein at least one panel of the front wall extends below the substantially horizontal edge of the front surface of the drawer in the closed condition of the enclosure and lockable in the condition so as to prevent opening of the drawer.

The construction of the enclosure permits the use of several varying types of locking mechanisms. In accordance with still another feature of the invention, it is provided that at least one of the side panels is formed with a hole, and including at least one slidable bolt mounted on the front panel inside the enclosure in the closed condition of the enclosure and in alignment with the hole, the bolt being slidable into the hole so as to lock the front panel to the side panel.

In accordance with a collateral feature of the invention, it is provided that the working area is at the top of a table having a front surface, and including means on one of the panels and the front surface of the table for cooperatively locking the enclosure in the closed condition thereof.

The enclosure is also equipped with means for preventing the panels from being separated from one another, therefore, in accordance with still a further feature of the invention, there are provided means rigid with the panels of the front wall and the top wall for securing the side panels in the closed position of the enclosure.

In accordance with this feature of the invention, it is provided that the rigid means are angle members.

The side panels may serve as an additional working surface adjacent the table-top. In accordance with another feature of the invention, it is provided that the working area is on a substantially horizontal surface of a table-top and the side panels are pivotable into a substantially horizontal position coplanar with the surface of the table-top in the collapsed condition of the enclosure, and including means for supporting the side panels in the substantially horizontal position thereof.

In accordance with a concomitant feature of the invention, there are provided means for maintaining the panels forming the front and top walls in the closed condition of the enclosure, in a position overlying the table-top working area in the collapsed condition of the enclosure.

Other features which are considered as characteristic for the invention are set forth in the appended claims.

Although the invention is illustrated and described herein as theft-proof table-top enclosure, it is nevertheless not intended to be limited to the details shown, since various modifications may be made therein without departing from the spirit of the invention and within the scope and range of equivalents of the claims.

The invention, however, together with additional objects and advantages thereof, will be best understood from the following description when read in connection with accompanying drawings, in which.

Figure 1:
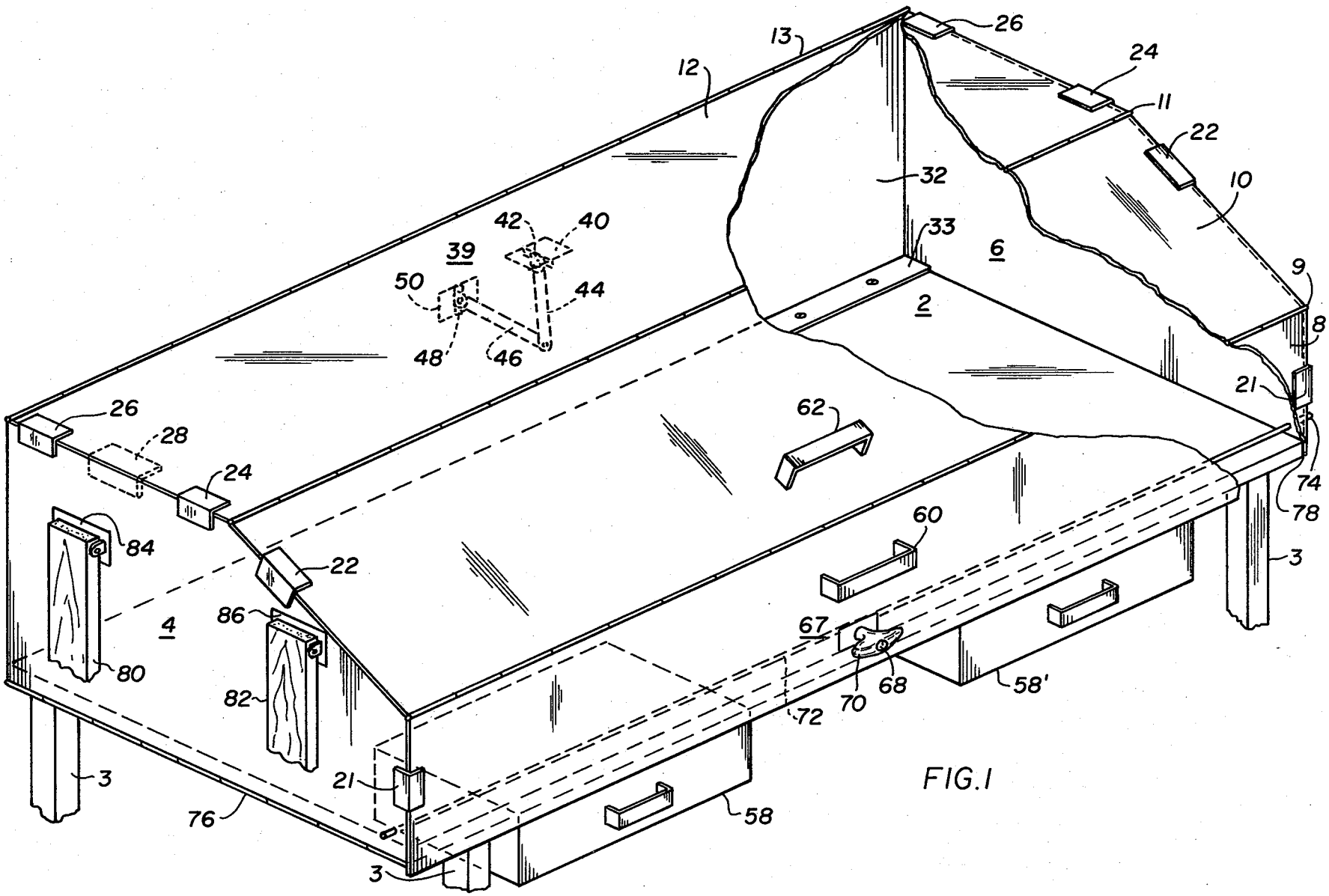
FIG. 1 is a perspective view, partly broken away, of the theft-proof table-top enclosure of the invention, shown in closed condition thereof.

Referring now to the drawings and first, particularly, to FIG. 1 thereof, there is shown a table-top or working surface 2 which is supported by legs 3, the table-top 2 and the legs 3 may be made of any conventional rigid or semi-rigid material, such as wood or metal. The enclosure is constructed with six basic elements which enclose an area above the table-top 2. The enclosure has a lower front panel 8, and an upper front panel 10 which, together, form a front wall, as well as a top panel or wall 12 and a back panel or wall 32. Between the lower front panel 8 and the upper front panel 10 is a continuous hinge 9, between the upper front panel 10 and the top panel 12 is a continuous hinge 11, and between the top panel 12 and the back panel 32 is a continuous hinge 13. These hinges 9, 11, 13 may be continuous like a piano hinge, as shown, or may be of any other suitable discontinuous type.

The edge of the back panel 32, nearest the table-top 2, is bent at an angle of approximately 90° to form a flange 33 (FIG. 2) which extends parallel to the table-top 2. The flange 33 is secured to the table-top 2 with screws or lag bolts 35, shown in FIG. 2. As is readily seen, when the enclosure is closed as in FIG. 1, the flange 33 and the bolts 35 are not exposed to the outside of the enclosure, and cannot be tampered with. At the side edges of the back panel 32 are channels 36, 36', having outer walls 37, 37' and inner walls 38, 38', shown in FIG. 2.

Figure 2:
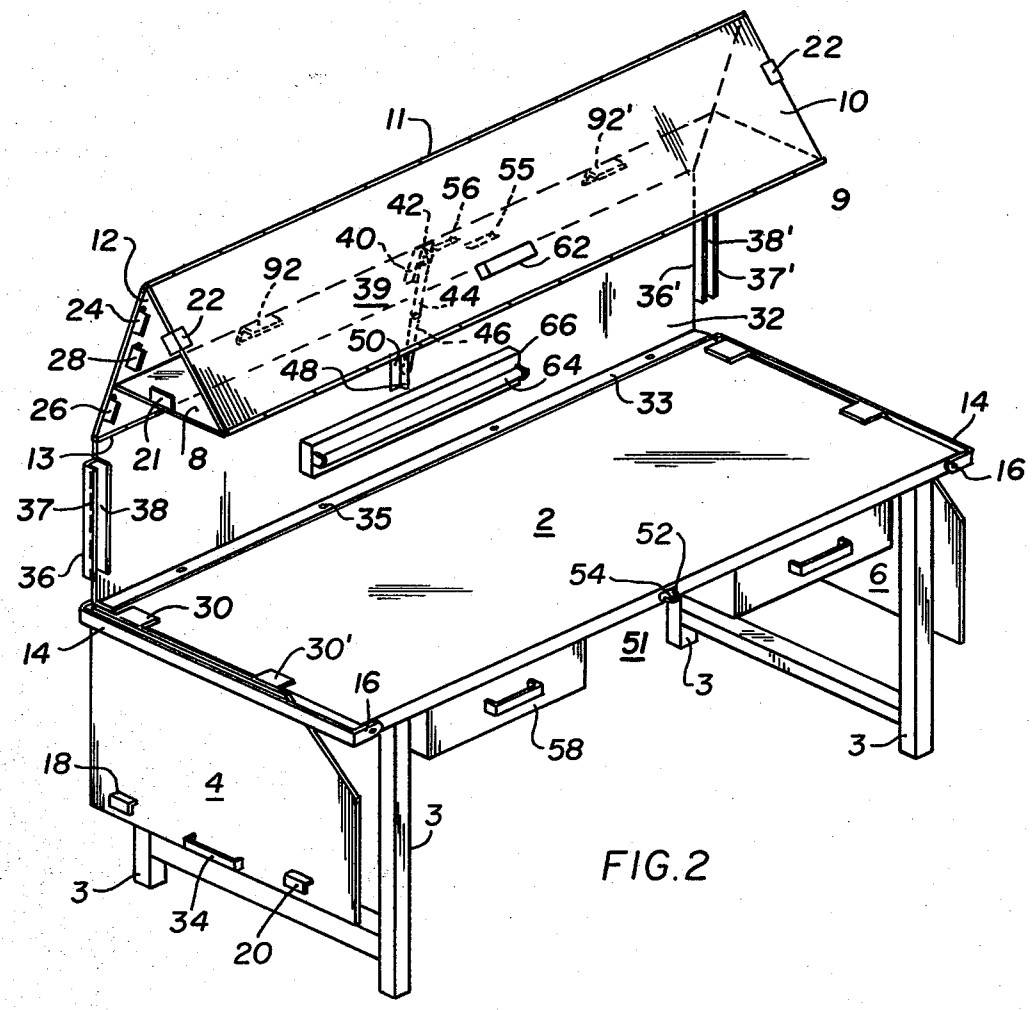
FIG. 2 is a perspective view similar to that of FIG. 1, of another embodiment of the invention, shown in open or collapsed condition thereof, on a reduced scale.

At the sides of the table-top 2 are end brackets 14 which are bent at right angles to form flanges 16, 16' that are secured to the front and back edges of the table-top 2 in the embodiment of FIG. 2. The end brackets 14 are dimensioned to be spaced from the side edges of the table-top 2. In the closed condition of the enclosure, the side panels 4, 6 which form side walls, are disposed in the channels 36, 36' and in the space between the end brackets 14 and the side edges of the table-top 2. Two tabs 18, 20 are secured to each side panel 4, 6, such as by spot welding, but may be punched out of the side panels. In the closed condition, the tabs 18, 20 rest on the end brackets 14 and hold the side panels 4, 6 in the up or closed position. A handle 34 is attached near the bottom of each side panel 4, 6. The handles 34 are disposed far enough below the brackets 18, 20 so that they will not interfere with the end brackets 14 when raising or lowering the side panels 4, 6 and are located below the end brackets 14 when the side panels 4, 6 are in the closed position.

The side edges of the outer surface of the lower front panel 8 and the upper front panel 10 have L-shaped tabs 21, 22, respectively, attached thereto, and the top panel 12 has two L-shaped tabs 24, 26 attached. These L-shaped tabs 21, 22, 24, 26 are disposed outside the side panels 4, 6 and serve to prevent them from separating outwardly from the other panels. Similarly, an L-shaped tab 28 is attached to the inner surface of the top panel 12 and is disposed inside the side panels 4, 6 to prevent the panels from separating inwardly. The tabs 21, 22, 24, 26 and 28 may be bent out of their respective panels. A theft-proof table-top enclosure is provided which sandwiches the side panels 4, 6 between the tabs to prevent tampering while in the closed condition thereof. Alternately, the end brackets 14 and the channels 36, 36' may be dispensed with and the side panels 4, 6 may be provided with hinges 76, 78, respectively, at the lower edge thereof, as shown in FIG. 1. The tabs 21, 22, 24, 26, 28 perform the same function of preventing opening of the side panels 4, 6 when the hinges 76, 78 are used. The hinges 76, 78 are spot-welded from the inside of the side panels 4, 6.

Figure 3:
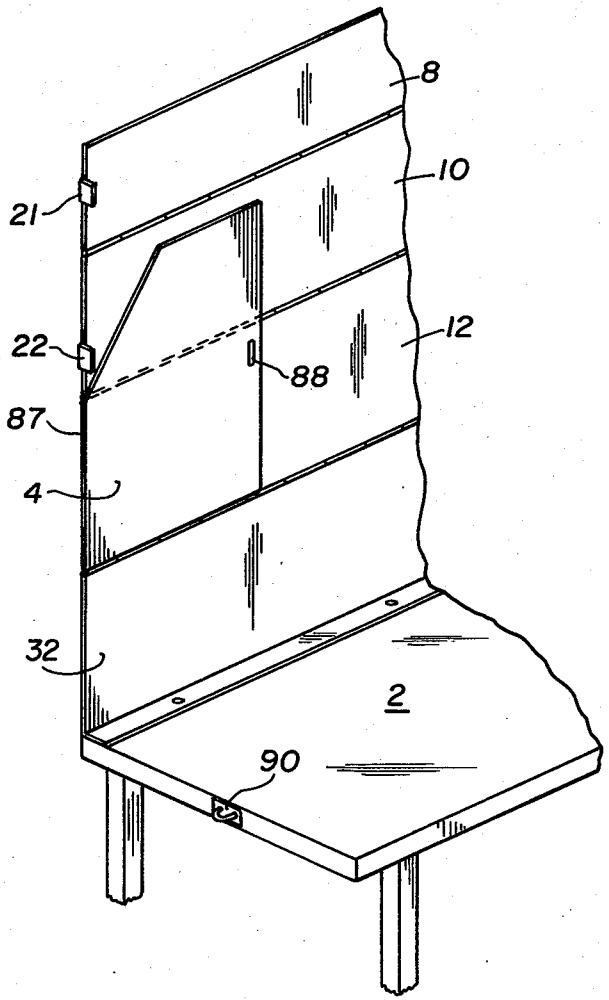
FIG. 3 is a fragmentary perspective view, broken away, of a further embodiment of the invention in open or collapsed condition thereof.

FIG. 3 shows another embodiment of the invention in which the channels 36, 36', the end brackets 14 and the tabs on the top panel 24, 26, 28 can be dispensed with. In this embodiment, the side panels 4, 6 are attached to the top panels by hinges 87. Attached to the side edges of the table-top 2 are staples 90 which fit into slots 88 formed in the side panels 4, 6 and can accept a lock when the enclosure is closed. The enclosure may therefore be collapsed by lifting the front and top panels 8, 10, 12 until they extend vertically above the back panel 32, and then swinging the side panels 4, 6 through 90° until they are disposed adjacent the top and front panels 12, 10. In this way, the enclosure may be stored completely out of the way in one substantially vertical plane, as shown. The panels may be held by a folding hinge 39, similar to that shown in FIG. 2, but disposed between the lower front panel 8 and the back panel 32, or the panels may simply be hooked to the ceiling of the room.

As can be seen in FIG. 1, the lower edge of the lower front panel 8 extends below the lower edge of the table-top 2 and across the top of drawers 58, 58' which may hang from under the table-top 2. The lower front panel 8 thereby prevents the drawers from being opened while the enclosure is closed, and eliminates the necessity for providing locks on the drawers.

At the center of the lower front panel 8, in FIG. 1, is a garage-type dead-bolt lock assembly, generally indicated at 67. When the handle 70 is turned to the horizontal position, as shown, dead-bolts 72, 74 protrude through holes formed in the side panels 4, 6, respectively. This prevents the lower front panel 8 and the upper front panel 10 and top panel 12 from being raised from the position thereof relative to the table-top 2 and the side panels 4, 6, as shown in FIG. 1. In the handle 70 is a lock 68 which prevents the handle 70 from being turned. When unlocked, the handle 70 can be turned to the vertical position whereby the dead-bolts 72, 74 slide out of the side panels 4, 6 towards each other in a conventional pivot arrangement. The enclosure may also be locked with a conventional staple and slot lock assembly 51 as shown in FIG. 2. When the lower front panel 8 is lowered into the closed position, a slot 55 formed therein is fitted over a staple 54 which protrudes from the front edge of the table-top 2. A padlock may be secured through a hole 52 formed in the staple 54 to prevent the enclosure from being opened.

When the enclosure is to be opened, the lock assembly 67, 51 is opened and the lower front panel 8, the upper front panel 10 and the top panel 12 are lifted out of the closed position thereof, shown in FIG. 1, into the open position thereof, shown in FIG. 2, through the use of handles 60, 62.

A conventional cover folding hinge 39 is provided on the inside surface of the top and back panels. The folding hinge 39 is made up of an upper arm 44 and a lower arm 46 which connect with each other at a pivot point. The upper arm 44 is pivoted to a plate 40 through bracket 42. The plate 40 is fastened near the rear edge of the top panel 12. The lower arm 46 is pivoted to a plate 50 through a bracket 48. The plate 50 is fastened near the upper surface of the back panel 32. When the enclosure is opened, the arms 44, 46 pivot from the acute angle which they form with one another in FIG. 1 to the obtuse angle shown in FIG. 2, so as to stiffen the hinge 13. The lower edge of the lower front panel 8 rests on the bracket 48 when in the open position of FIG. 2, as well as on brackets 92, 92' which are rigid with the top panel 10 and add support.

If desired, the enclosure may be stored in a position in which the hinge 11 between the upper front panel 10 and the top panel 12 is above all of the other elements and the front panels 8, 10, the top panel 12 and the back panel 32 are all disposed in one substantially vertical plane.

The front and top panels 8, 10, 12 may also be stored in the open position by aligning the panels so that the front panels 8, 10 abut the top panel 12 and the back panel 32 extending perpendicularly to the table-top 2.

In the embodiment of FIG. 2, when the front and top panels 8, 10, 12 are raised, the side panels 4, 6 are freed from the tabs 21, 22, 24, 26, 28 and have a certain amount of vertical play. This play allows the side panels 4, 6 to be lifted slightly so that the tabs 18, 20 are disengaged from the brackets 14 and then lowered into the position shown in FIG. 2 by sliding the tabs 18, 20 through the space between the end brackets 14 and the table-top 2. This is facilitated through the use of the handles 34. The side panels 4, 6 have means for releasably securing the side panels 4, 6 forming the side walls. In FIG. 2 they are shown as stops 30, 30' attached to the upper edge thereof which engage the table-top 2 and hold the side panels 4, 6 within the end brackets 14 in the open position thereof, but may be of many other types, such as spring pins. When the side panels 4, 6 are raised, the stops 30, 30' are disposed out of the way beyond the edges of the inside tab 28.

Similarly, in FIG. 1, hinges 76, 78 are used to secure the side panels 4, 6 to the table-top 2, the side panels 4, 6 may then be swung out and down through 180° to rest at the side of the table. Either construction effectively allows complete removal of the side panel 4, 6 from obstruction of the working area and the space adjacent thereto.

In the embodiment of FIG. 1, there are shown collapsible legs 80, 82 which are pivotable on plates 84, 86, respectively, that are attached to the side panels 4, 6. The legs 80, 82 may be pivoted through 90° to support the side panels as an extension of the work surface of the table-top 2. The side panels 4, 6 then extend parallel to the table-top 2 in the open condition of the enclosure.

Inside the back panel 32, below the plate 50, may be located a light 64 on a base 66. The light is covered when the enclosure is closed and is ideally situated for providing light when the enclosure is open.

There are claimed:

1. A theft-proof collapsible enclosure for a table-top working area comprising a plurality of panels disposed, in closed condition of the enclosure, in separate mutually intersecting planes in a position above the table-top working area, said plurality of panels forming a top wall, a front wall and two side walls of the enclosure in said closed condition thereof, the panels of at least said top wall and said front wall being pivotable about respective substantially horizontal axes at the mutual intersections thereof so as to collapse the enclosure, said panels forming said side walls being pivotable about respective substantially horizontal axes at the mutual intersections of said panels forming said side walls with said separate planes of the remainder of said plurality of panels.

2. A theft-proof enclosure according to claim 1, wherein said plurality of panels are disposed in one substantially vertical plane in a collapsed condition of the enclosure.

3. A theft-proof collapsible enclosure for a table-top working area comprising a plurality of panels disposed, in closed condition of the enclosure, in separate mutually intersecting planes in a position above the table-top working area, said plurality of panels forming a top wall, a front wall and two side walls of the enclosure in said closed condition thereof, the panels of at least said top wall and said front wall being pivotable about respective substantially horizontal axes at the mutual intersections thereof so as to collapse the enclosure, said panels forming said side walls being movable from the position above the table-top working area, in the planes of the separate mutually intersecting planes wherein they are disposed in the closed condition of the enclosure, to a position below the working area in the collapsed condition of the enclosure.

4. A theft-proof enclosure according to claim 3, including means for limiting downward movement of said panels forming said side walls to said position thereof below the working area.

5. A theft-proof enclosure according to claim 3 including means for releasably securing said panels forming said side walls in said closed condition of the enclosure.

6. A theft-proof collapsible enclosure for a table-top working area comprising a plurality of panels disposed, in closed condition of the enclosure, in separate mutually intersecting planes in a position above the table-top working area, said plurality of panels forming a top wall, a front wall and two side walls of the enclosure in said closed condition thereof, the panels of at least said top wall and said front wall being pivotable about respective substantially horizontal axes at the mutual intersections thereof so as to collapse the enclosure, and including means rigid with the panels of said front wall and said top wall and permanently secured thereto for securing said side panels in said closed position of the enclosure.

7. A theft-proof enclosure according to claim 6 wherein said rigid means are angle members having extensions in a plane parallel to the plane in which said side walls are disposed.

8. A theft-proof collapsible enclosure for a table-top working area comprising a plurality of panels disposed, in closed condition of the enclosure, in separate mutually intersecting planes in a position above the table-top working area, said plurality of panels forming a top wall, a front wall and two side walls of the enclosure in said closed condition thereof, the panels of at least said top wall and said front wall being pivotable about respective substantially horizontal axes at the mutual intersections thereof so as to collapse the enclosure, and including means for maintaining the panels forming said front and top walls in said closed condition of the enclosure, in a position overlying the table-top working area in said collapsed condition of the enclosure.

* * * * *